US010126041B2

(12) United States Patent
Park et al.

(10) Patent No.: US 10,126,041 B2
(45) **Date of Patent: *Nov. 13, 2018**

(54) REFRIGERATOR

(71) Applicant: LG ELECTRONICS INC., Seoul (KR)

(72) Inventors: Jisu Park, Seoul (KR); Seungho Lee, Seoul (KR); Jaeyoul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/237,703

(22) Filed: Aug. 16, 2016

(65) Prior Publication Data

US 2016/0356543 A1 Dec. 8, 2016

Related U.S. Application Data

(63) Continuation of application No. 14/808,319, filed on Jul. 24, 2015, now Pat. No. 9,441,872.

(30) Foreign Application Priority Data

Aug. 27, 2014 (KR) ..... 10-2014-0112184

(51) Int. Cl.
*F25D 23/02* (2006.01)
*F25D 11/02* (2006.01)
(Continued)

(52) U.S. Cl.
CPC ..... *F25D 23/028* (2013.01); *E05B 65/0042* (2013.01); *E05C 3/30* (2013.01);
(Continued)

(58) Field of Classification Search
CPC ..... F25D 23/02; F25D 23/028; F25D 23/04; F25D 23/025; F25D 2323/02;
(Continued)

(56) References Cited

U.S. PATENT DOCUMENTS 1,329,453 A 2/1920 Bohn
2,238,530 A 4/1941 Lickteig
(Continued)

FOREIGN PATENT DOCUMENTS

GB 2 409 236 A 6/2005
JP S55-8826 6/1978
(Continued)

OTHER PUBLICATIONS

U.S. Notice of Allowance dated May 25, 2016 issued in U.S. Appl. No. 14/808,319.
(Continued)

*Primary Examiner* — Andrew M Roersma
(74) *Attorney, Agent, or Firm* — Ked & Associates, LLP

(57) ABSTRACT

A refrigerator includes a cabinet having a storage chamber, a main door pivotably mounted to the cabinet while including an opening provided at an inside of the main door, and a stepped portion provided around the opening, a sub-storage chamber mounted at the inside of the main door, a sub-door mounted to the main door, to allow a user to have access to the sub-storage chamber, the sub-door having opposite side surfaces with front portions protruding forwards of a front surface of the main door while having a greater width than the opening and stepped portion between the front portions of the side surfaces, to cover the stepped portion by the side surfaces, and a hinge pivotably mounted to the main door and coupled to the sub-door while being bent at an intermediate portion thereof, to pivotably support the sub-door with respect to the main door.

7 Claims, 11 Drawing Sheets

(51) Int. Cl.

| | |
|---|---|
| ***E05C 19/00*** | (2006.01) |
| ***E05D 7/00*** | (2006.01) |
| ***F25D 23/04*** | (2006.01) |
| ***E05B 65/00*** | (2006.01) |
| ***E05C 3/30*** | (2006.01) |
| ***E05C 7/02*** | (2006.01) |

(52) U.S. Cl.
CPC ..... *E05C 7/02* (2013.01); *E05C 19/00* (2013.01); *E05D 7/00* (2013.01); *F25D 11/02* (2013.01); *F25D 23/02* (2013.01); *F25D 23/025* (2013.01); *F25D 23/04* (2013.01); *E05Y 2900/31* (2013.01); *F25D 2201/00* (2013.01); *F25D 2201/126* (2013.01); *F25D 2323/023* (2013.01); *F25D 2323/024* (2013.01)

(58) Field of Classification Search
CPC ..... F25D 2323/023; F25D 2323/024; F25D 2400/18; E05D 7/00; E05C 19/00
See application file for complete search history.

(56) References Cited

U.S. PATENT DOCUMENTS

| | | | | |
|---|---|---|---|---|
| 2,309,001 | A | 1/1943 | Nave et al. | |
| 2,469,113 | A | 5/1949 | Hooker | |
| 2,978,755 | A | 4/1961 | Walker | |
| 3,065,035 | A | 11/1962 | Biesecker | |
| 4,306,757 | A | 12/1981 | Horvay | |
| 4,586,347 | A | 5/1986 | McCarty | |
| 4,732,432 | A | 3/1988 | Keil | |
| 5,349,832 | A | 9/1994 | Johnson | |
| 5,630,630 | A * | 5/1997 | Price | E05B 17/2003 292/128 |
| 5,988,709 | A | 11/1999 | Lee | |
| 7,651,181 | B2 | 1/2010 | Bauer | |
| 7,984,955 | B2 | 7/2011 | Jung | |
| 2005/0200253 | A1 | 9/2005 | Wissinger | |
| 2006/0265960 | A1 | 11/2006 | Leimkuehler et al. | |
| 2008/0143227 | A1 | 6/2008 | Kim | |
| 2009/0314028 | A1 | 12/2009 | Laible | |
| 2010/0154457 | A1 | 6/2010 | Kim et al. | |
| 2010/0236589 | A1 | 9/2010 | House | |
| 2011/0089790 | A1 | 4/2011 | Lee | |
| 2011/0309730 | A1 | 12/2011 | Retchloff | |
| 2012/0043873 | A1 | 2/2012 | Jeon | |
| 2012/0062093 | A1 | 3/2012 | Lee | |
| 2012/0326587 | A1 | 12/2012 | Jeong | |
| 2013/0014533 | A1 | 1/2013 | Choi | |
| 2013/0026900 | A1 * | 1/2013 | Oh | F25D 23/02 312/401 |
| 2013/0111941 | A1 | 5/2013 | Yu | |
| 2013/0270990 | A1 | 10/2013 | Park | |
| 2014/0132144 | A1 | 5/2014 | Kim | |
| 2014/0232251 | A1 | 8/2014 | Kim et al. | |
| 2015/0069900 | A1 * | 3/2015 | Lim | F25D 23/028 312/405 |
| 2015/0176886 | A1 | 6/2015 | Lee | |

FOREIGN PATENT DOCUMENTS

| | | | |
|---|---|---|---|
| JP | S57-085184 | | 5/1982 |
| JP | 2003-021452 | A | 1/2003 |
| JP | 2003-065659 | A | 3/2003 |
| JP | 2003-262454 | A | 9/2003 |
| KR | 1999-0031602 | | 7/1999 |
| KR | 10-2004-0021442 | A | 3/2004 |
| KR | 10-2011-0138772 | A | 12/2011 |
| KR | 10-2012-0140392 | A | 12/2012 |
| WO | WO 2004/033974 | A1 | 4/2004 |
| WO | WO 2005/038181 | A2 | 4/2005 |
| WO | WO 2007/031469 | | 3/2007 |
| WO | WO 2014/038190 | | 3/2014 |

OTHER PUBLICATIONS

European Search Report dated Dec. 23, 2015 issued in Application No. 15178047.5.
U.S. Office Action issued in U.S. Appl. No. 14/808,319 dated Mar. 15, 2016.
European Office Action dated Jun. 20, 2017 issued in Application No. 15178047.5.

* cited by examiner

REFRIGERATOR

CROSS-REFERENCE TO RELATED APPLICATIONS

This application is a Continuation Application of prior U.S. patent application Ser. No. 14/808,319 filed Jul. 24, 2015, which claims priority under 35 U.S.C. § 119 to Korean Application No 10-2014-0112184 filed on Aug. 27, 2014, whose entire disclosures are hereby incorporated by reference.

BACKGROUND

1. Field

The present disclosure relates to a refrigerator.

2. Background

Generally, a refrigerator is an appliance for storing food within a storage chamber in a frozen or refrigerated state by discharging into the storage chamber, cold air generated through a refrigeration cycle constituted by a compressor, a condenser, an expansion valve, an evaporator, etc. Such a refrigerator includes, as storage compartments, a freezing compartment for storing food or beverages in a frozen state, and a refrigerating compartment for storing food or beverages at low temperature.

Refrigerators may be classified into a top mounting type refrigerator in which a freezing compartment is arranged over a refrigerating compartment, a bottom freezer type refrigerator in which a refrigerating compartment is arranged over a freezing compartment, and a side-by-side type refrigerator in which a freezing compartment and a refrigerating compartment are laterally arranged.

Recently developed refrigerators have various functions in addition to original functions to store food in a refrigerated or frozen state. For example, a dispenser is installed at the door of a refrigerator to supply purified water or ice. In addition, a display is installed at a front surface of the door to display states of the refrigerator so as to allow the user to manage the refrigerator.

Recently developed refrigerators have a tendency toward an enlargement in capacity. For efficient utility of storage spaces, a door rack or a storage case is additionally provided at the inside of a refrigerator door, e.g., a refrigerating compartment door, in order to provide a space for storing food articles. The storage case, which is provided as a space separate from a storage chamber in a refrigerator, is referred to as a "home bar" or an "auxiliary storage compartment".

In order to allow the user to have access to the auxiliary storage compartment without opening the refrigerating door to open the entirety of the refrigerating compartment, an opening may be formed at the refrigerating door, and a sub-door may be mounted to the opening in order to open or close the opening. The sub-door may have a size equal to or smaller than the main door. The sub-door may be mounted to be vertically pivotable with respect to a horizontal axis or to be laterally pivotable with respect to a vertical axis.

However, there are problems. For example, when the sub-door is smaller than the main door, a gap is formed between the edge of the opening and the edge of the sub-door in a state in which the opening of the main door is closed by the sub-door. The gap is viewed at front side and as such, appearance beauty may be degraded. Furthermore, cold air may leak through the gap.

In addition, the sub-door is mounted in such a manner that the sub-door is embedded in the opening and as such, there is a problem in that the pivot angle of the sub-door is insufficient. The structure of a latch device to selectively couple the sub-door to the main door is also complex. Since the latch device is mounted after passing through the sub-door, there is also a problem in that cold air may leak through a mounting portion of the latch device.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to the embodiments of the present disclosure, examples of which are illustrated in the accompanying drawings. Although the illustrated refrigerator is a top mounting type refrigerator, the present disclosure may also be applied to refrigerators of other types.

Figure 1:
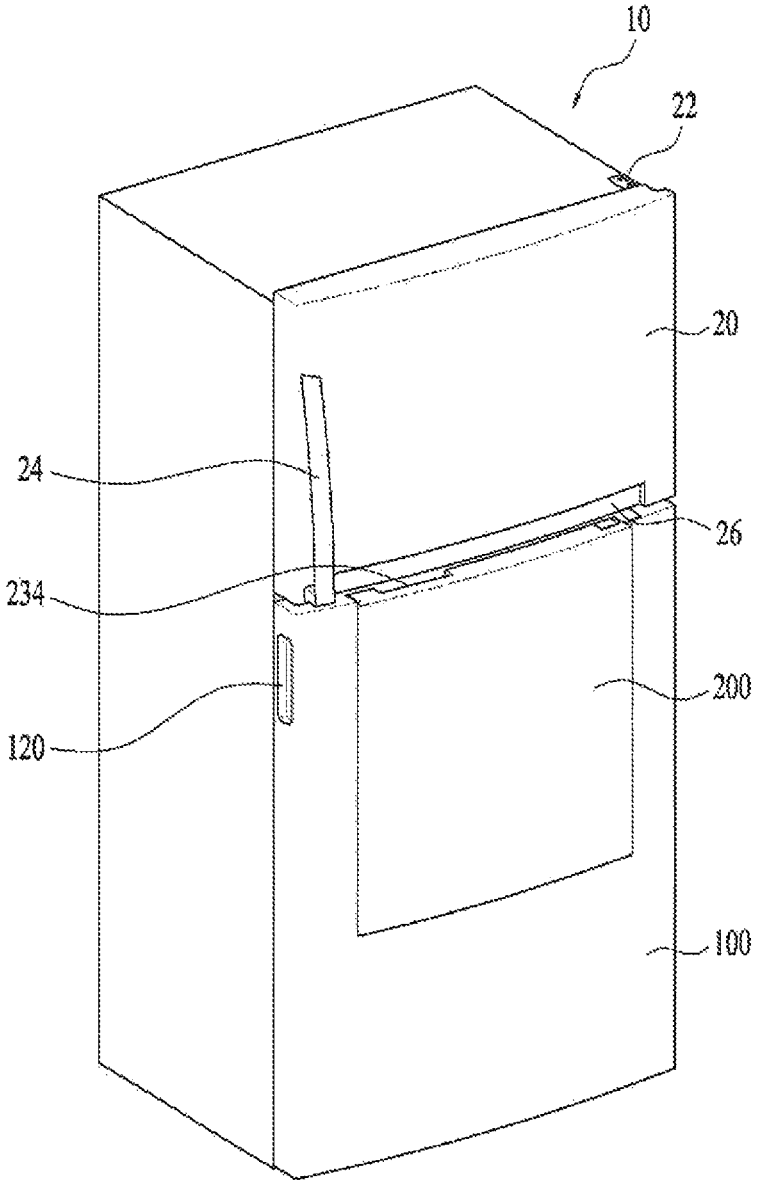
FIG. 1 is a perspective view illustrating a refrigerator according to a preferred embodiment of the present disclosure.
Figure 2:
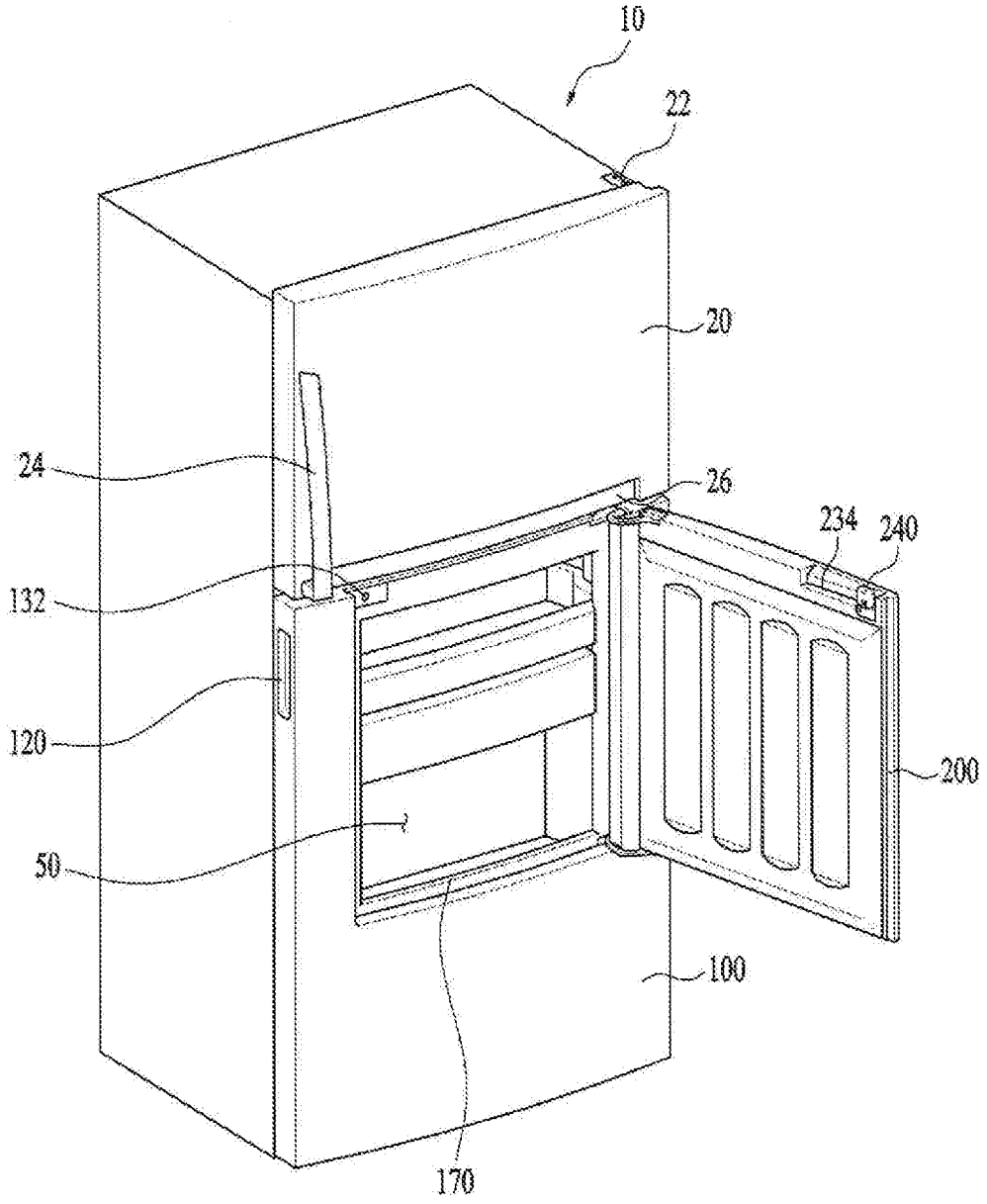
FIG. 2 is a perspective view illustrating an opened state of a sub-door in FIG. 1.

The configuration of a refrigerator according to an embodiment of the present disclosure will be described with reference to FIGS. 1 and 2. A freezing compartment 30 (FIG. 6) is arranged at a top side of a cabinet 10, and a refrigerating compartment is arranged at a bottom side of the cabinet 10. A freezing compartment door 20 to open or close the freezing compartment may be pivotably mounted to the cabinet 10 by a hinge 22 provided at a right side of the top of the cabinet 10.

A handle 24 may be provided at a left side of a front surface of the freezing compartment door 20. The handle 24 is mounted to protrude forwards. The handle 24 may take the form of a groove formed at a side surface or bottom surface of the freezing compartment door 20 without protruding from the front surface of the freezing compartment door 20.

A refrigerating compartment door to open or close the refrigerating compartment may be pivotably mounted to the cabinet 10 by a hinge provided at a right side of the bottom of the cabinet 10. In the illustrated embodiment, the refrigerating compartment door includes a main door pivotably mounted to a right side of the cabinet 10, and a sub-door 200 having a smaller size than the main door 100 while being mounted to be pivotable with respect to the main door 100.

A handle 120 to open or close the main door 100 may be provided at a left side surface of the main door 100 while taking the form of a groove.

An opening 170 is formed through the main door 100 at the inside of the main door 100. A sub-storage compartment 50 is provided at a backside of the main door 100, as a storage space separate from the refrigerating compartment. The sub-storage compartment 50 is disposed forwards of the refrigerating compartment when the main door 100 is closed. The sub-storage compartment 50 may take the form of a case so as to be partitioned from the refrigerating compartment. Although the sub-storage compartment 50 has a smaller width and a smaller vertical size than the refrigerating compartment, a plurality of racks may be mounted in the sub-storage compartment 50 so as to achieve efficient use of the storage space in the sub-storage compartment 50.

The sub-door 200 may have a smaller size than the main door 100 and, as such, allows the user to have access to the sub-storage compartment 50 mounted at the inside of the main door 100 when the sub-door 200 is opened. A handle groove 234 may be provided at a left side of a top surface of the sub-door 200 so as to allow the user to pull the sub-door 200 while grasping the handle groove 234 upon opening only the sub-door 200.

A latch device 240 is mounted in the handle groove 234. The latch device 240 includes a hook member 247 (FIG. 8) to be engaged in an engagement groove 132 provided at an upper portion of the front surface of the main door 100. In detail, the engagement groove 132, which engages with the hook member 247, is provided at one side of a front upper surface in a stepped structure of the main door 100 to define the opening 170. The engagement groove 132 of the latch device 240 will be described later in detail.

A groove 26, which has a slightly greater width than the opening 170, may be provided at a lower end portion of the front surface of the freezing compartment door 20. The groove 26 allows the user to easily find the handle groove 234 and to easily insert the fingers into the handle groove 234. If there is no groove 26, it may be difficult to easily find the handle groove 234 and to insert the fingers into the handle groove 234 because the spacing between the bottom surface of the freezing compartment door 20 and the refrigerating door or sub-door 200.

Figure 3:
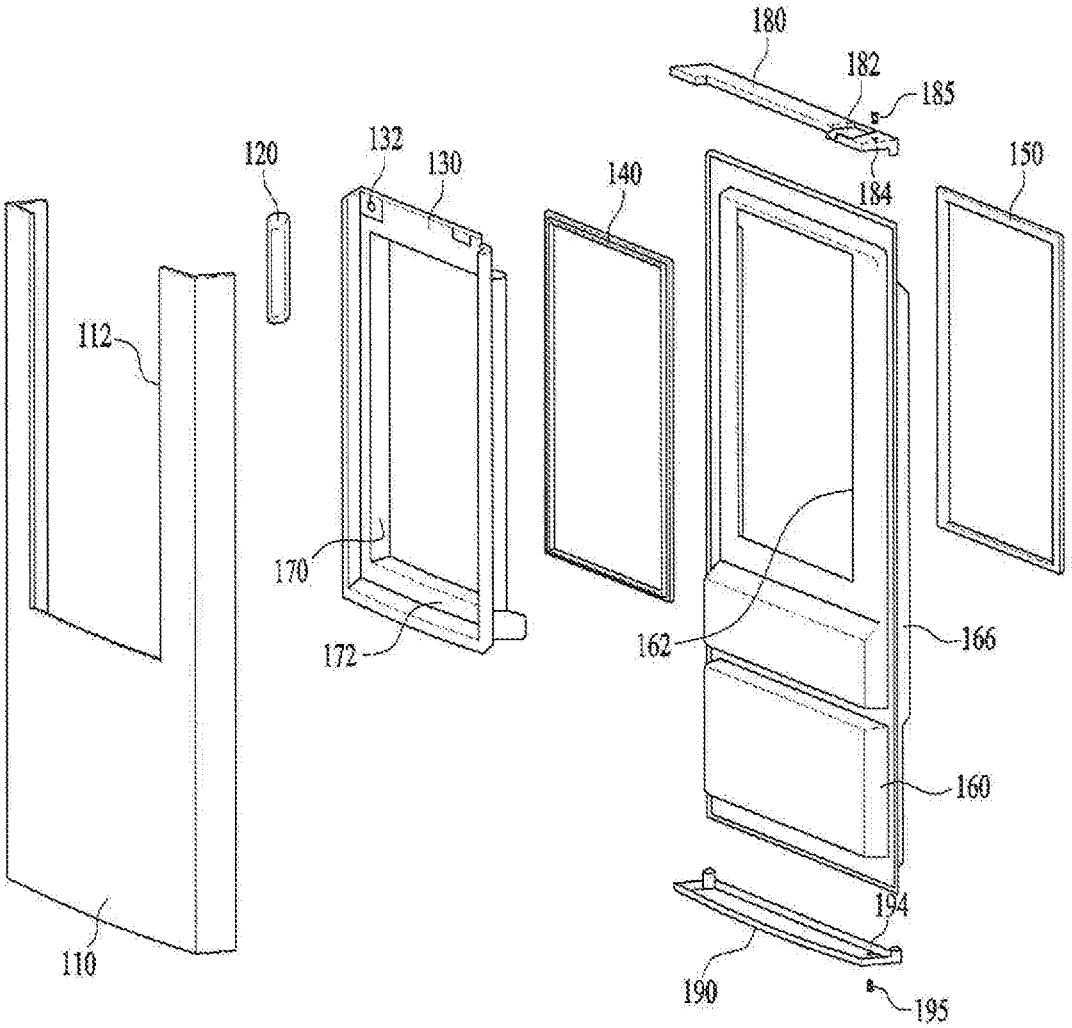
FIG. 3 is an exploded perspective view taken when a main door is viewed at front side.

Hereinafter, an assembly structure of the main door 100 will be described in detail with reference to FIG. 3. An outer door to define the front surface and opposite side surfaces of the main door 110 and a door liner 160 to define a back surface of the main door 110 are coupled. In FIG. 3 the outer door is designated by reference numeral "110" designating the main door.

The outer door 110 takes a U shape when viewed at top side. An opening 112 is centrally formed at an upper portion of the outer door 110. The opening 112 is upwardly opened. A hole may be formed at an upper portion of a left side surface of the outer door 110 and, as such, the handle 120, which has a concave groove shape, may be mounted to the hole.

An opening 162 corresponding to the opening 112 of the outer door 110 is also formed at an upper portion of the door liner 160. The opening 162 has a structure surrounded by an edge of the door liner 160. A pair of door dikes 166 may be provided at opposite sides of a back surface of the door liner 160 in an integrated manner. Each door dike 166 protrudes rearwards while being vertically elongate. Although not shown, a gasket of the main door 100 is formed along an edge of the back surface of the door liner 160. The gasket may be mounted in grooves provided outside the door dikes 166.

A frame cover 130 and a magnetic gasket 140 are mounted between the outer door 110 and the door liner 160. The frame cover 130 is mounted at the inside of the opening 112 of the outer door 110. The opening 170 is formed at the inside of the frame cover 130 in a stepped manner.

The front surface portion of the frame cover 130 surrounding the opening 170 is disposed rearwards of the front surface of the outer door 110, and the lateral ends and lower end of the front surface portion of the frame cover 130 are connected to the front surface of the outer door 110. Accordingly, the front surface portion of the frame cover 130 may be referred to as a "stepped portion 172".

The stepped portion 172 may be formed with the opening 170 at the inside thereof, and may include an opened upper surface, and side surfaces and a lower surface, which extend forwards from the lateral ends and lower ends of the stepped portion 172, respectively. The opposite lateral edges and lower edge of the frame cover 130 are formed to have a stepped structure, the upper edge of the frame cover 130 has a flat plate structure, and these edges are connected to have an integrated structure.

The engagement groove 132, in which the hook member 247 of the latch device 240 is engagable, is provided at a left upper side of the front surface of the stepped portion 172 in the frame cover 130. Although the engagement groove 132 may simply take the form of a through hole, a separate member formed with the engagement groove 132 may be coupled to a groove formed at a left side of the upper edge of the frame cover 130.

The magnetic gasket 140 is mounted to the back surface of the frame cover 130. The magnetic gasket 140 is not adapted to contact the front surface of the cabinet 10, but is adapted to interact with a gasket 224 of the sub-door 200. A groove (not shown) may be formed at the back surface of the frame cover 130 along the edge of the frame cover 130, to receive the magnetic gasket 140.

In addition, a coupling member 150 may be provided to fix the magnetic gasket 140 to the frame cover 130. The coupling member 150 is coupled to the frame cover 130 so as to cause the magnetic gasket 140 to be fixed in a fitted manner in the groove provided at the back surface of the frame cover 130. For coupling of the coupling member 150 to the frame cover 130, a plurality of engagement grooves may be provided around the back surface groove of the frame cover 130, and a plurality of engagement protrusions corresponding to the engagement grooves may be provided at the coupling member 150.

Cap decorations 180 and 190 are coupled to top and bottom surfaces formed in accordance with coupling of the outer door 110 and door liner 160, respectively. A pivot groove 182 is provided at a right side of an upper surface of the upper cap decoration 180 so as to mount a pivot shaft of an upper hinge of the sub-door 200. The pivot groove 182 has a shape capable of not only mounting the pivot shaft of the upper hinge thereto, but also receiving a front half portion of the pivot shaft when the upper hinge pivots.

A pin hole 184 is provided at a right end of the upper cap decoration 180, to mount a pivot shaft 185 of an upper hinge of the main door 100. A pin hoe 194 is provided at the right end of the lower cap decoration 190, to mount a pivot shaft 195 of a lower hinge of the main door 100.

A procedure of assembling the main door 100 will be described hereinafter. First, the magnetic gasket 140 is fitted in the frame cover 130, and the coupling member 150 is then coupled to the frame cover 130. After coupling the frame cover 130 to the inside of the opening 112 of the outer door 110, the door liner 160 is coupled to the outer door 110.

Thereafter, the upper cap decoration 180 and lower cap decoration 190 are coupled to the top and bottom surfaces formed in according with coupling of the outer door 110 and door liner 160. A foaming material is injected into an inner space of the main door 100 assembled as described above.

Figure 4:
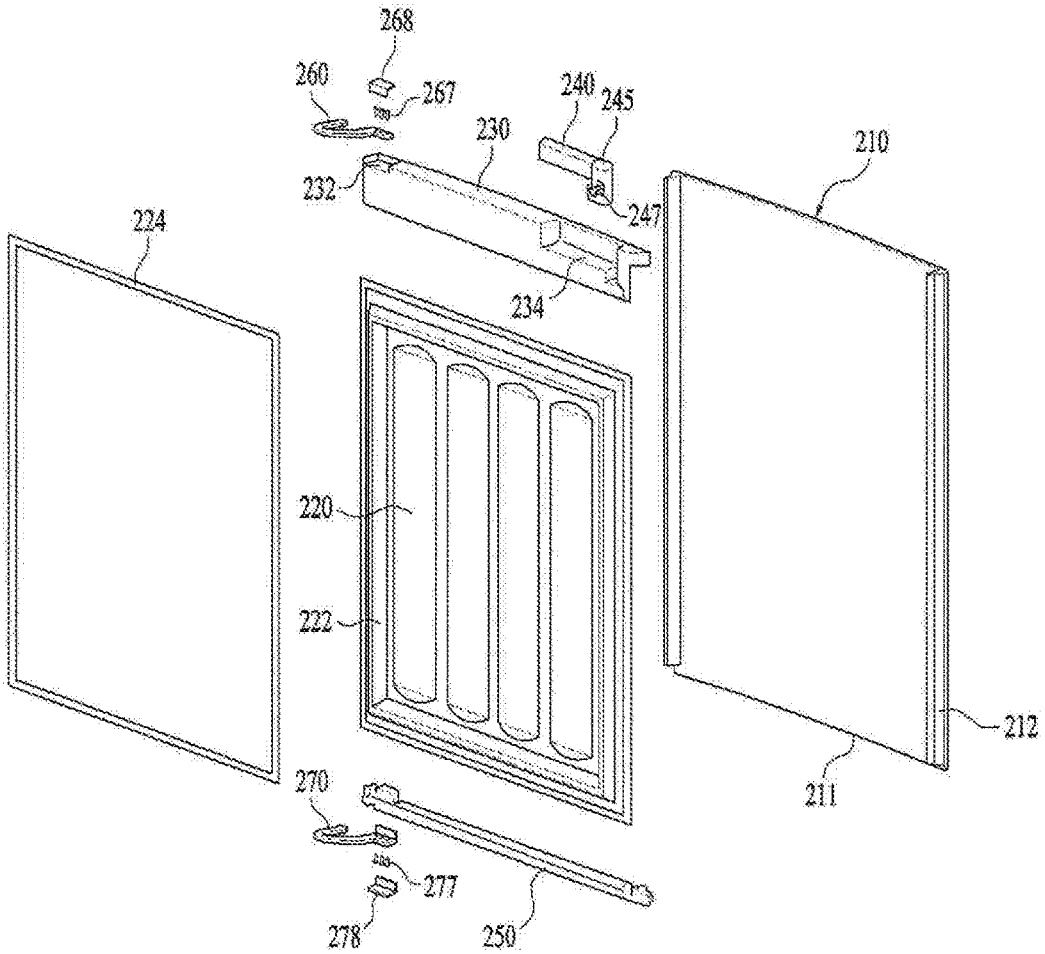
FIG. 4 is an exploded perspective view taken when the sub-door is viewed at back side.

Hereinafter, an assembled structure of the sub-door 200 will be described in detail with reference to FIG. 4. An outer door 210 to define the front surface and opposite side surfaces of the sub-door 200 and a door liner 220 is coupled to the sub-door 200 to define the rear surface of the sub-door 200. The outer door 210 may include a front surface portion 211 forming the front surface of the outer door 210, and side surface portions 212 bent rearwards from opposite lateral ends of the front surface portion 211. The front surface portion 211 may have a flat surface. Alternatively, the front surface portion 211 may have a slightly convex surface.

In a state in which the sub-door 200 is closed, the rear sides of the side surface portions 212 are positioned at the opening 170 of the main door 100 inside the stepped portion 172, and the front sides of the side surface portions 212 are positioned forwards of the front surface of the main door 100.

Front portions of opposite side surfaces of the sub-door 200 are protruded forwards of the front surface of the main door 100. Since the width between the front portions of opposite side surfaces of the sub-door 200 is greater than the width of the opening 170 and the width of the stepped portion 172, the stepped portion 172 is covered by opposite ends of the sub-door 200.

Since opposite ends of the sub-door 200 covers the stepped portion 172, the gap between the outer side surface of the stepped portion 172 in the main door 100 and the rear side surface of the sub-door 200 is hidden at front side. Opposite rear edges of the sub-door 200 have a shape corresponding to those of the opening 170 and stepped portion 172 of the main door 100.

A door dike 222 may be formed at the back surface of the door liner 220, to protrude along an edge of the back surface in an integrated manner. The gasket 224, which has a rectangular shape, is mounted at the outside of the door dike 222. When the sub-door 200 is closed, the gasket 224 contacts the front surface of the stepped portion 172 surrounding the opening of the main door 100.

A magnet 226 (FIG. 5) is received in the interior of the gasket 224, as will be described later. Accordingly, when the sub-door 200 is closed, sealing effects may be enhanced by virtue of interacting attraction generated between the magnet 226 and the magnetic gasket 140 mounted at the inside of the stepped portion 172 of the main door 100 and, as such, leakage of cold air may be prevented.

Cap decorations 230 and 250 are coupled to top and bottom surfaces formed in accordance with coupling of the outer door 210 and door liner 220, respectively. A coupling groove 232 is provided at one side of an upper portion of the upper cap decoration 230 coupled to the top surface. An upper hinge 260 is coupled to the coupling groove 232. At the other side of the upper portion of the upper cap decoration 230, the handle groove 234, to which the latch device 240 is coupled, is provided.

A plurality of holes is formed at the coupling groove 232, to fasten a plurality of screws 267. A plurality of holes, through which the screws 267 will pass, is also formed at one end of the upper hinge 260. After coupling the upper hinge 260 to the coupling groove 232, a cover 268 is mounted to the coupling groove 232. In accordance with mounting of the cover 268, it may be possible to prevent occurrence of a problem associated with safety such as jamming of fingers without degrading appearance.

A coupling groove 252 (FIG. 7) is also provided at one side of a lower portion of the lower cap decoration 250 coupled to the bottom surface. A lower hinge 270 is coupled to the coupling groove 232, and is fastened by a plurality of screws 277. Similarly to the above-described case, a cover 278 is mounted to the coupling groove 252 after coupling the lower hinge 270 to the coupling groove 251.

A procedure of assembling the above-described sub-door 200 will be described. Rear ends of the side surface portions 212 of the outer door 210 and the door liner 220 are coupled. The latch device 240 is mounted in the handle groove 234 of the upper cap decoration 230. Thereafter, the upper cap decoration 230 and lower cap decoration 250 are coupled to the top surface and bottom surface formed in accordance with coupling of the outer door 210 and door liner 220 respectively.

Similarly to the main door 100, a foaming material may be injected into an inner space of the sub-door 200 assembled as described above. Subsequently, the upper hinge 260 is coupled to the upper cap decoration 230, and the lower hinge 270 is coupled to the lower cap decoration 250. Then, it may be possible to mount the upper hinge 260 and lower hinge 270 to the main door 110.

Figure 5:
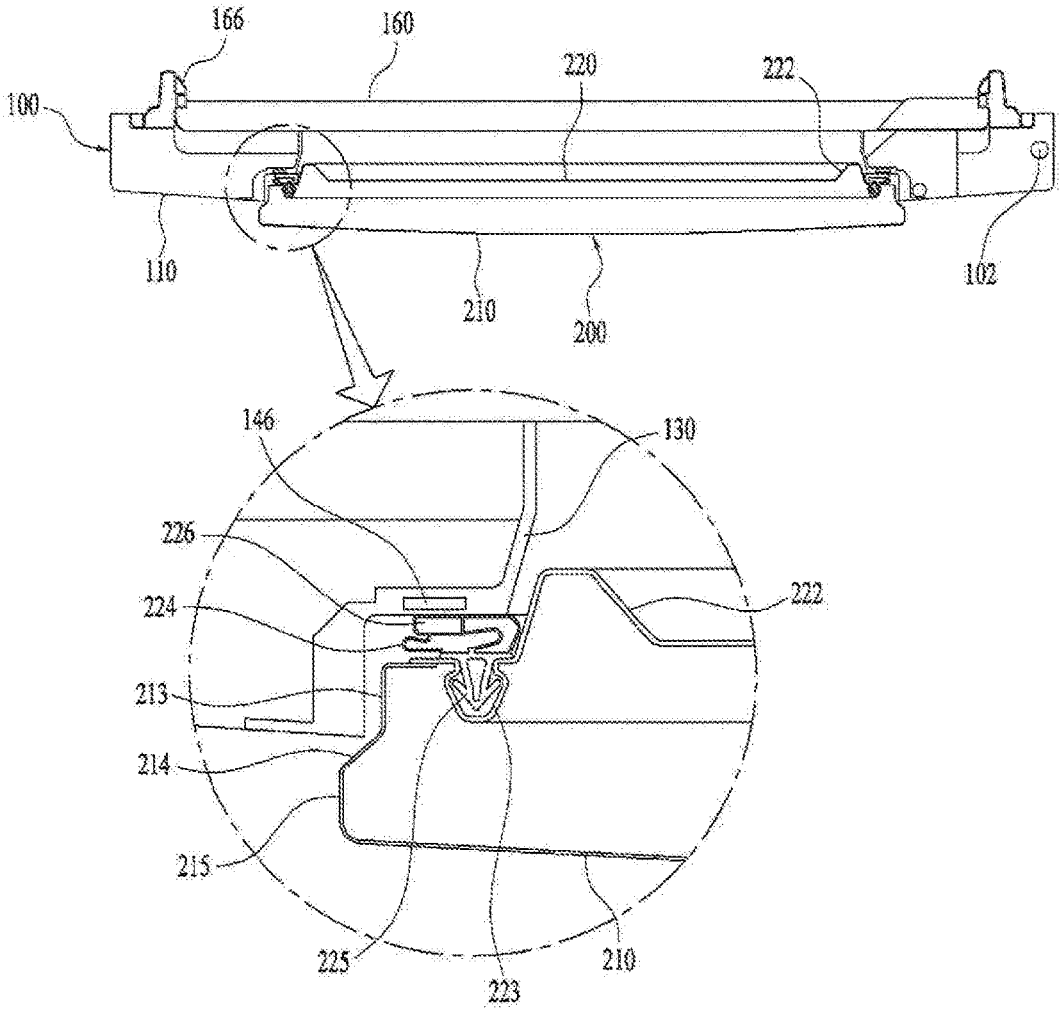
FIG. 5 is a horizontal sectional view illustrating the main door and sub-door.

In FIG. 5, a horizontal sectional view is shown to illustrate a closed state of the sub-door 200 with respect to the main door 100. As described above, a pair of door dikes 166 is formed at the back surface of the door liner 160 of the main door 100, and grooves are formed outside the door dikes 166, to receive the gasket of the main door 100. The outer door 210 of the sub-door 200 forms the front and side surfaces of the sub-door 200, and is coupled to the door liner 220 forming the back surface of the sub-door 200 at opposite rear ends thereof.

The door dike 222 is formed at the door liner 220 in an integrated manner and, as such, is positioned inside the opening 170 when the sub-door 200 is closed. Mounting grooves 223 to mount the gasket 224 are provided at opposite ends of the door liner 220. Mounting protrusions 225 to be fitted in the mounting grooves 223 are provided at the gasket 224. The gasket 224 is made of rubber or a flexible synthetic resin material. The gasket 224 may be provided with the magnetic member 226 installed therein. A metal member or magnetic member 146 may be provided at the interior of the stepped portion 172 in the frame cover 130 of the main door 100.

The metal member or magnetic member 146 may form at least a portion of the magnetic gasket 140. The gasket 224 may more effectively prevent leakage of cold air because, when the sub-door 200 is closed with respect to the main door 100, the magnetic member 226 contacts front surface of the stepped portion 172 by virtue of attraction between the magnetic member 226 and the metal member or magnetic member 146 and, as such, an increase in contact force is generated.

Each side surface of the sub-door 200 may include a first surface 213 disposed inside the stepped portion 172 while extending forwards from the back surface of the sub-door 200, a second surface 214 extending inclinedly from the first surface 213 outwards and forwards of the stepped portion 172, and a third surface 215 disposed outwards and forwards of the stepped portion 172 while extending forwards from a front end of the second surface.

Each side surface of the sub-door 200 is formed by the outer door 210. All the first surface 213, second surface 214, and third surface 215 may be formed integrally with the outer door 210 as a part of the outer door 210. The first surface 213 is positioned rearwards of the front surface of the main door 100 while being arranged in front of the stepped portion 172 when the sub-door 200 is closed. In this state, the second surface 214, which is an inclined surface extends forwards of the front surface of the main door 100 and, as such, is arranged to face an edge formed between the side surface of the stepped portion 172 and the front surface of the main door 100.

The third surface 215 occupies a large thickness part of the portion of the sub-door 200 protruding forwards of the front surface of the main door 100. The third surface 215 is formed not only to provide a sufficient thickness of the sub-door 200 in order to secure a sufficient thermal insulation performance of the foaming material injected into the sub-door 200, but also to provide a round side edge of the sub-door 200. The side surface of the sub-door 200 forms an acute angle smaller than 90° with respect to the front surface by the inclined surface, namely, the second surface 214.

In prior sub-door, the sub-door is completely inserted inside the opening and stepped portion of the main door and, as such, side surfaces of the sub-door form flat surfaces. In prior sub-door, bent portions, which are bent inwards from rear ends of the side surfaces, are provided and, as such, cap decorations are fitted between the bent portions after widening the bent portions.

The cap decorations 230 and 250 are assembled, using a method of widening opposite side surfaces of the outer door 210, and then fitting the cap decorations 230 and 250 between the widened side surfaces. In the case of the sub-door 200 according to the present disclosure, the side surfaces of the outer door 210 should be further widened upon coupling the cap decorations 230 and 250 because the second surface 214 is inclinedly formed at an intermediate portion of each side surface of the outer door 210. Nevertheless, coupling of the cap decorations 230 and 250 through widening of the side surfaces 212 of the outer door 210 is possible and, as such, the cap decorations 230 and 250 may be more firmly coupled.

If the second surface 214 is vertically bent with respect to the first surface 213, the angle of the entirety of the side surface 212 of the outer door 210 may be more acute. In accordance with the present disclosure, however, the second surface 214 is gently inclined and, as such, it may be possible to reduce the inclination angle of the entirety of the side surface 212 and to allow increased dimension tolerance of the side surface 212 upon fabricating the outer door 210.

In addition, since the second surface 214 is inclined, the gap between the front surface of the main door 100 and the second surface 214 is hardly viewed. Furthermore, it is possible to more effectively prevent leakage of cold air through the gap.

Figure 6:
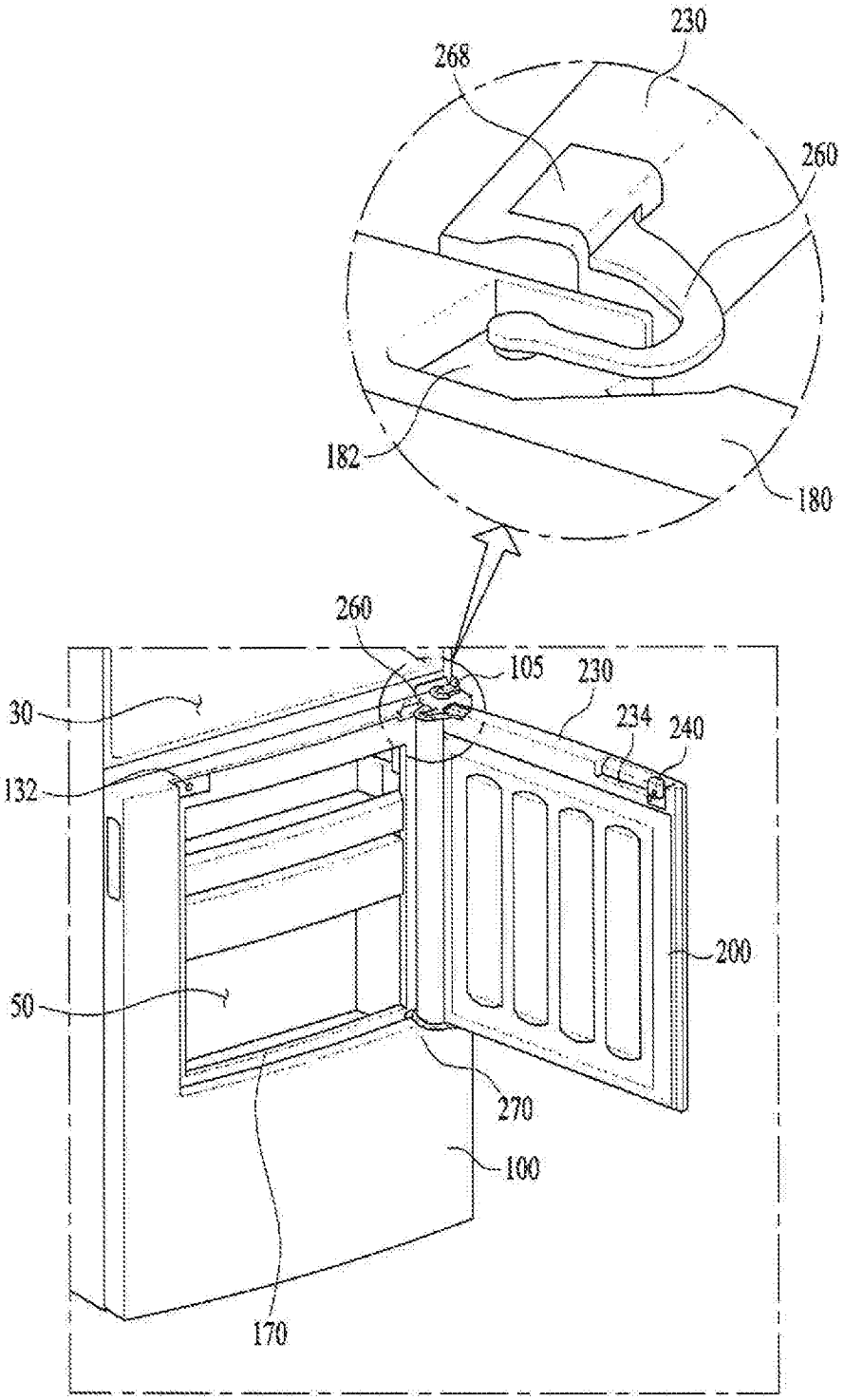
FIG. 6 is an enlarged perspective view illustrating upper hinge areas of the main door and sub-door.

Mounting structures of the upper hinge and lower hinge in the sub-door will be described with reference to FIGS. 6 and 7. The upper hinge 260 is pivotably mounted to the pivot groove 182 formed at the upper cap decoration 180 forming the top surface of the main door 100, using a pivot shaft provided at one end of the upper hinge 260. The other end of the upper hinge 260 is mounted to the coupling groove 232 of the upper cap decoration 230 forming the top surface of the sub-door 200. The cover 268 is then coupled to the coupling groove 232.

Since the upper hinge 260 is bent at the intermediate portion thereof, the upper hinge 260 may be opened through an increased angle without interfering with the main door 100. In the main door 100, the hinge of the main door 100 is mounted outside the pivot groove 182, in which the pivot shaft of the upper hinge 260 is mounted. This hinge is coupled to a right side of an intermediate portion of the cabinet 10, and is arranged between the freezing compartment door 20 and the refrigerating compartment door, namely, the main door 100. The hinge includes a pivot shaft 105 protruding vertically and, as such, the freezing compartment door 20 disposed at top side and the main door 100 disposed at bottom side are pivotably mounted and supported in an independent manner. The pivot shaft 105 is inserted in a shaft hole 102 provided on the top surface of the main door 100.

The lower hinge 270 is pivotally mounted to a groove 174 provided at one side of the bottom of the stepped portion 172 in the main door 100, using a pivot shaft 271 provided at one end of the lower hinge 270. The other end of the lower hinge 270 is fastened to the lower cap decoration 250 forming the bottom surface of the sub-door 200. A cover 278 is then coupled to the lower cap decoration 250.

Figure 7:
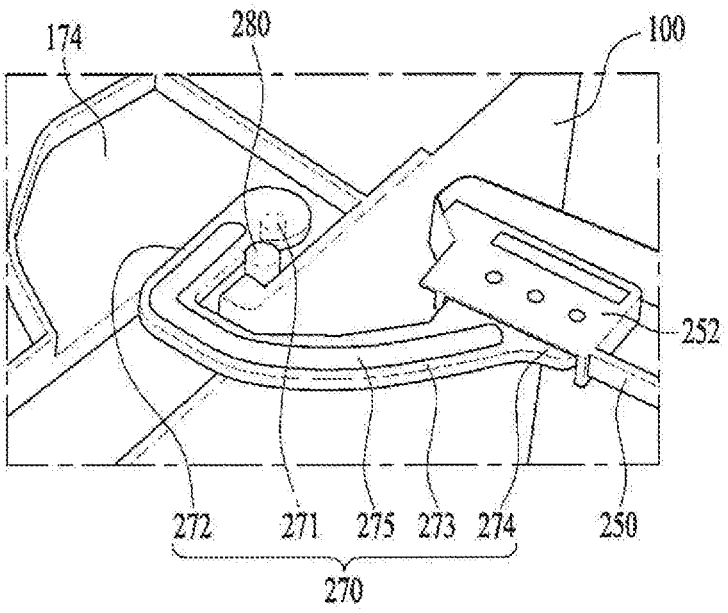
FIG. 7 is a partially-broken enlarged perspective view illustrating a lower hinge area of the sub-door.

In FIG. 7, a detailed shape of the lower hinge 270 is illustrated. In the following description, hinge shape will be described in conjunction with the lower hinge 270. The same hinge shape may also be applied to the upper hinge 260. FIG. 7 is a perspective view taken along the line passing just above the lower hinge in a state in which the sub-door is opened with respect to the main door.

The lower hinge 270 may include a pivot shaft portion mounted to the groove 174 provided at the main door 100, a coupling portion 274 coupled to a lower end of the sub-door 200, and connecting portions 272 and 273 connecting the pivot shaft portion and the coupling portion while having a bent structure. A pivot shaft 271 protruding downwards is provided at a lower surface of the pivot shaft portion. The pivot shaft 271 may be mounted in a pin hole provided at the groove 174. The coupling portion 274 is fastened to the coupling groove 252 provided at the lower cap decoration 250 forming the bottom surface of the sub-door 200 by a plurality of screws. The cover 278 is then coupled at bottom side, as described.

The connecting portion may include a straight section 272 extending from the pivot shaft, and a curved section bent from the straight section 272 and connected to the coupling portion 274. When the lower hinge 270 pivots maximally, the straight portion 272 may be disposed to be parallel to the front surface of the main door 100.

The curved portion 273 extends from the straight portion 272, which is disposed rearwards of the front surface of the main door 100, and further extends to a position disposed forwards of the front surface of the main door 100 in a direction approximately perpendicular to the front surface of the main door 100. A reinforcing rib 275 may be provided at the straight portion 272 and curved portion 273 in order to achieve an enhancement in support force.

A stopper 280 is provided at the groove 174 of the main door 100, in which the lower hinge 270 is mounted, so as to limit a maximum pivot angle of the lower hinge 270. The stopper 280 protrudes upwards from the bottom of the groove 174. A side surface of the straight portion 272 of the lower hinge 270 may selectively contact the stopper 280, to be supported by the stopper 280.

Generally, hinges are made of a metal material having sufficient strength in order to pivotably support a heavy door. In this connection, the stopper 280 may be also made of a metal material having sufficient strength in order to absorb inertia force and impact. The stopper 280 may also be provided at the upper pivot groove 182 of the main door 100, in which the upper hinge 260 is mounted. However, the stopper 280 may be provided only at the lower hinge 270 because the sub-door 200 is considerably smaller and lighter than the main door 100, and the weight of the sub-door 200 is mainly applied to the lower hinge 270.

Figure 8:
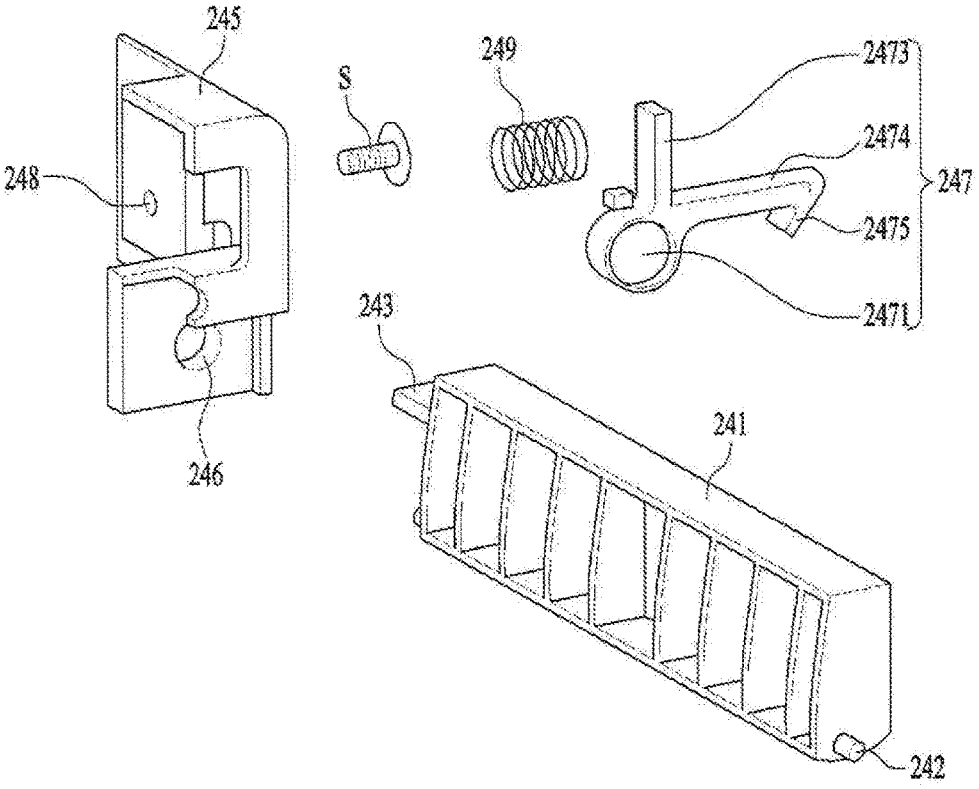
FIG. 8 is an exploded perspective view of a latch device.
Figure 9:
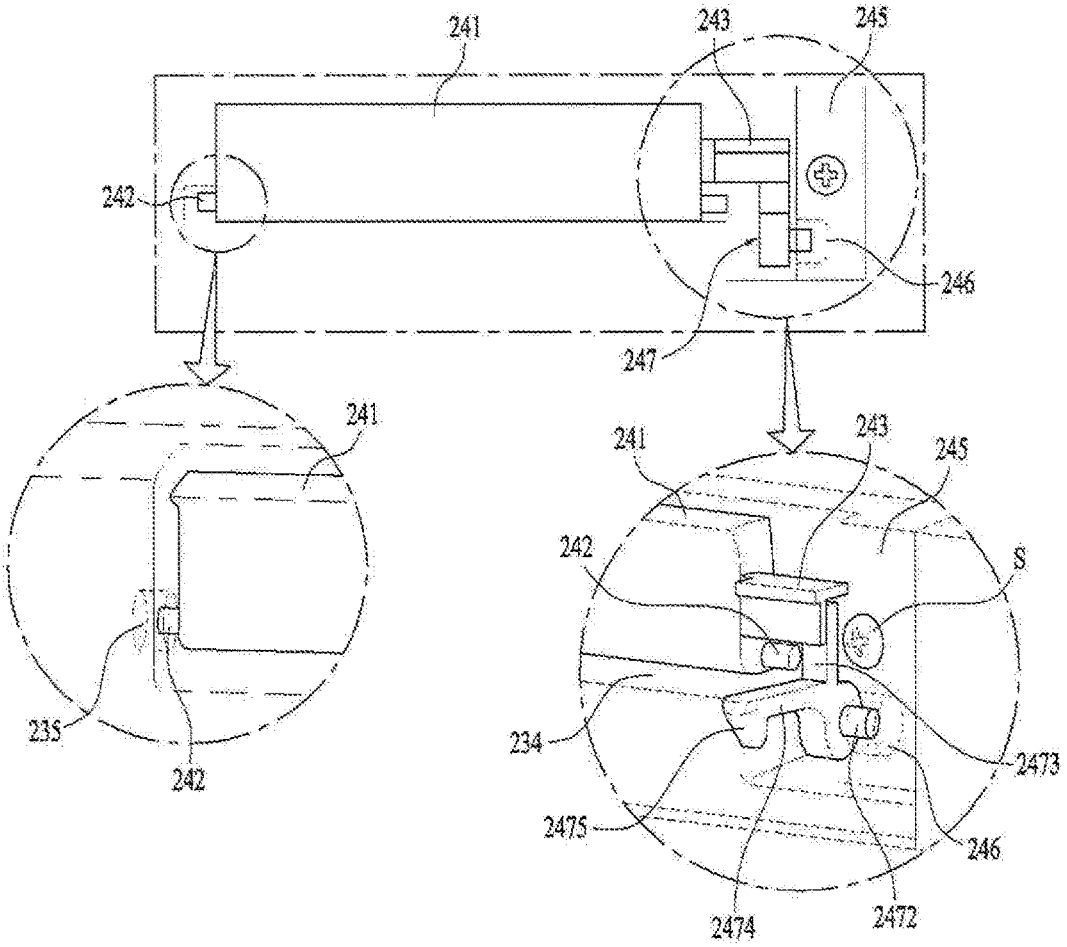
FIG. 9 is a view illustrating mounting of the latch device to a mounting groove of the sub-door.

Hereinafter, the structure and operation relation of the latch device will be described with reference to FIGS. 8 to 10. The latch device 240 includes the hook member 247, which is pivotably mounted to one side of the handle groove 234, and a lever member 241 mounted to the handle groove 234, to pivot the hook member 247. The lever member 241 may be pivotably mounted as pivot axial protrusions 242 protruding laterally from opposite side surfaces of the lever member 241 are inserted into axial grooves 235 formed at opposite sides of the handle groove 234, respectively.

The lever member 241 has a thickness equal to or smaller than half the thickness of the handle groove 234, so as to be pivotable within the handle groove 234. A lever 243 protrudes from one side surface of the lever member 241 to pivot the hook member 247. The hook member 247 is pivotably mounted to a groove portion formed at one side of the handle groove 234 while having a greater depth than the handle groove 234. The hook member 247 may have an integrated structure including an upper extension portion 2473 extending upwards from the pivot axis portion, and a rear extension portion 2474 extending rearwards from the pivot axis portion.

To this end, a bracket 245 may be further provided in order to mount the hook member 247 to the groove portion. The bracket 245 may be coupled to one side of the handle groove 234 through a through hole 248 formed at the bracket 245 by a screw S.

An axial groove 2471 may be formed at one surface of a pivot axis portion of the hook member 247. An axial protrusion 2472 may be formed at the other surface of the pivot axis portion. A protrusion (not shown), which is inserted into the axial groove 2471, may be provided at a side surface of the groove portion. A groove 246, in which the axial protrusion 2472 is received, may be provided at one side surface of the bracket 245.

When the user pivots the lever member 241, the upper extension portion 2473 may be pivoted by the lever 243. An elastic member 249 is mounted between the upper extension portion 2473 and the back surface of the handle groove 234, to return the upper extension portion 2473 to an original position thereof after pivoting. The elastic member 249 may be constituted by a coil spring.

A hook member 2475 may be provided at an end of the rear extension portion 2474 in an integrated manner. The hook member 2475 is bent through an acute angle of 90° or less. The hook member 2475 is engaged in the engagement groove 132 provided at the main door 100 and, as such, the sub-door 200 may be maintained in a state of being coupled to the main door 100. A vertical slot may be provided at a front surface of the bracket 245 in order to allow the upper extension portion 2473 to pass through the vertical slot so as to pivot through a predetermined angle.

Figure 10:
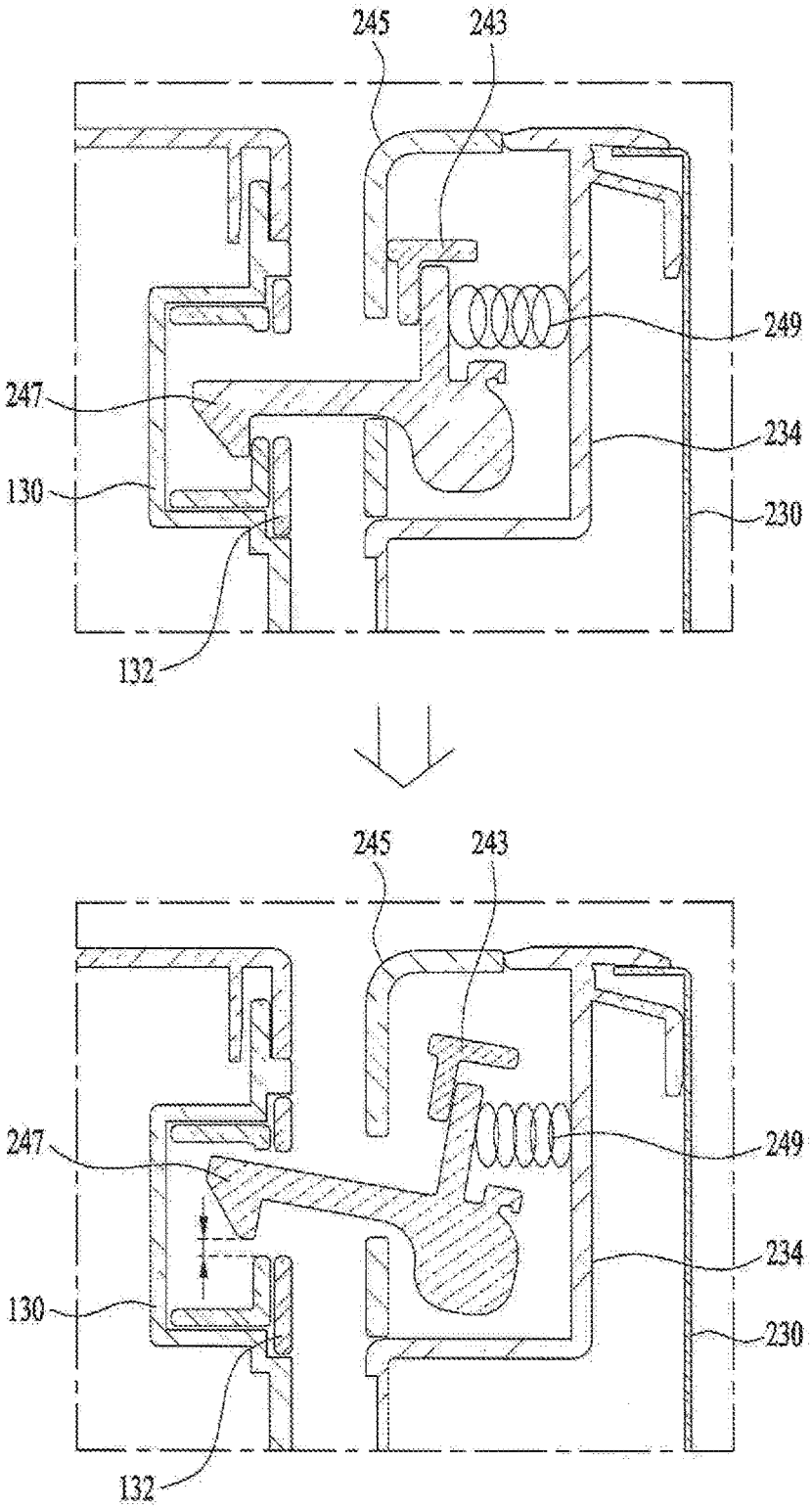
FIG. 10 is a vertical sectional view illustrating operation of the latch device.

In a state in which the sub-door 200 is coupled to the main door 100, as illustrated in FIG. 10, the hook member 247 is maintained in a state of being engaged in the engagement groove 132 because the elastic member 249 pushes the upper extension portion 2473. When the user pulls the lever member 241, to pivot the lever member 241, the lever 243 pivots the upper extension portion 2473 of the hook member 247 and, as such, the hook 2475 of the hook member 247 is lifted to be separated from the engagement groove 132.

The sub-door 200 is separable from the main door 100. In this state, the user may open the sub-door 200 by pulling the handle groove 234. Practically, when the user simply pulls the handle groove 234 while inserting the fingers into the handle groove 234, the lever member 241 is pivoted, thereby causing the hook member 247 to pivot. Accordingly, the engagement state of the hook member 247 in the engagement groove 132 is released and, as such, the sub-door 200 is opened.

In accordance with the latch device of the present disclosure, it may be possible to prevent the locking state of the latch device from being unintentionally released due to inertia or air pressure generated during door closing, even when impact is applied to the main door by intensely closing the main door in a state in which the sub-door is coupled to the main door.

Figure 11A:
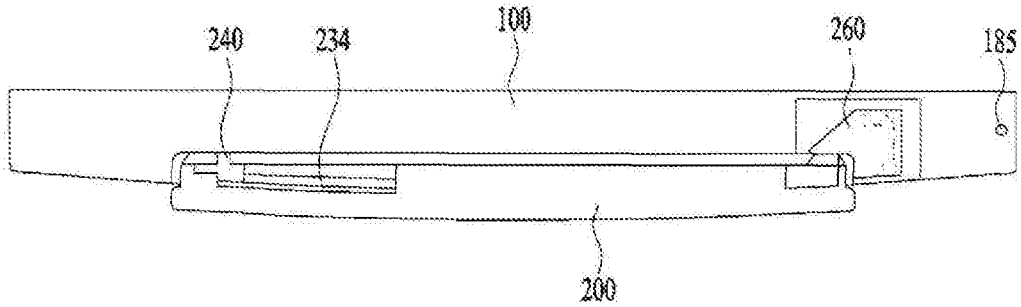
FIGS. 11A and 11B are plan views illustrating opened and closed states of the sub-door with respect to the main door.
Figure 11B:
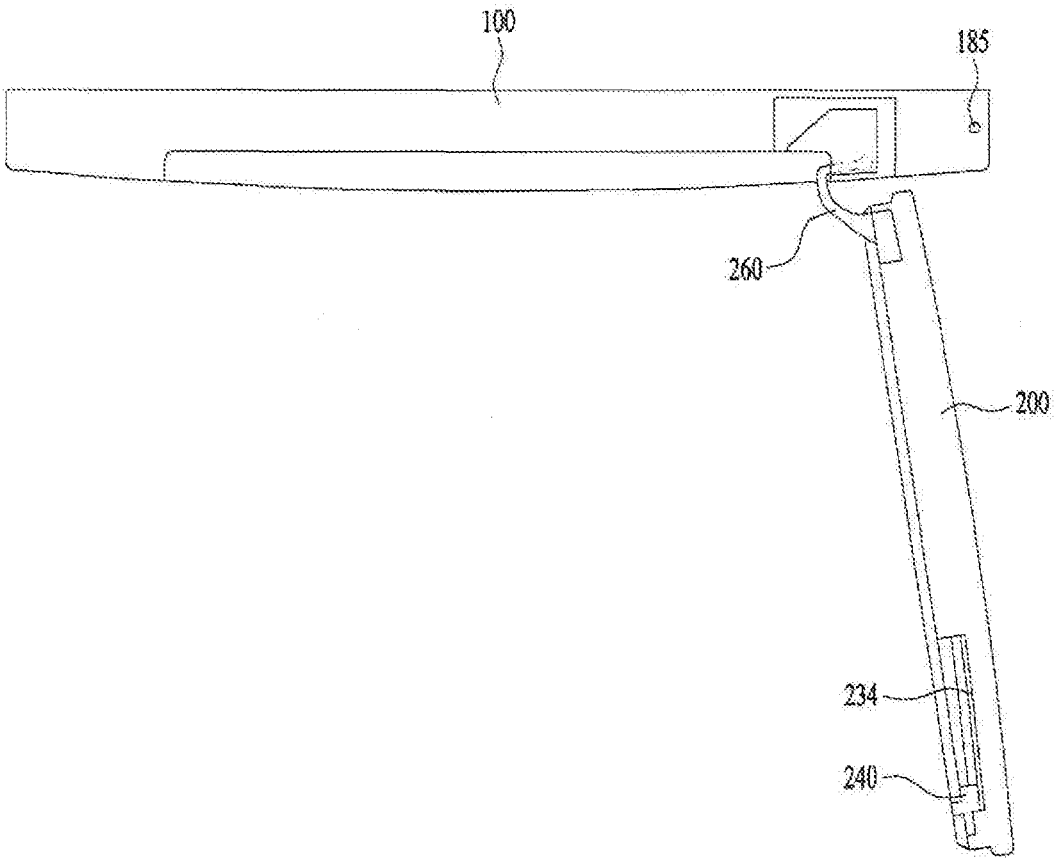

Finally, in FIGS. 11A and 11B, plan views are shown to illustrate closed and opened states of the sub-door with respect to the main door, respectively. When the sub-door 200 is closed with respect to the main door 100, as illustrated in FIG. 11A, the gap between the opening of the main door 100 and the side surface of the sub-door 200 is completely hidden when the refrigerator is viewed at front side or lateral side and, as such, the outline of the sub-door 200 is viewed as a single outline.

When the user pulls the lever member 241 of the handle groove 234, the main door 100 is maintained in a closed state with respect to the cabinet 10, and only the sub-door 200 is opened in accordance with pivotal movement thereof, as illustrated in FIG. 11B.

Since the hinge 260 has a bent structure at the intermediate portion thereof, the sub-door 200 may pivot up to an angle of about 110° without interfering with the main door 100, even though the width of the sub-door 200 is greater than the width of the opening.

In a refrigerator according to the present disclosure, it may be possible to prevent the gap between an opening of a main door and a sub-door smaller than the main door from being viewed at front side, thereby minimizing leakage of cold air without degrading appearance beauty.

Although the sub-door has a greater width than the opening of the main door, it may be possible to sufficiently increase the opening angle of the sub-door through application of a hinge having a bent structure at an intermediate portion thereof.

A refrigerator according to the present disclosure may be capable of mounting a sub-door smaller than a main door to an opening of the main door while securing a sufficient opening angle of the sub-door, and mounting a latch device without passing through the sub-door while simplifying the structure of the latch device, thereby achieving easy operation of the latch device and preventing leakage of cold air.

A refrigerator may include a cabinet defined with a storage chamber therein, a main door pivotably mounted to the cabinet, to open or close the storage chamber, the main door comprising an opening provided at an inside of the main door, and a stepped portion provided around the opening, a sub-storage chamber mounted at the inside of the main door, a sub-door mounted to the main door, to open or close the opening so as to allow a user to have access to the sub-storage chamber, the sub-door having opposite side surfaces with front portions protruding forwards of a front surface of the main door while having a greater width than the opening and the stepped portion between the front portions of the opposite side surfaces, to cover the stepped portion by the opposite side surfaces, and a hinge pivotably mounted, at one end thereof, to the main door and coupled, at the other end thereof, to the sub-door while having a bent structure at an intermediate portion thereof, to pivotably support the sub-door with respect to the main door.

The sub-door may have, at opposite rear edges thereof, a shape corresponding to the opening and the stepped portion of the main door.

Each of the side surfaces of the sub-door may include a first surface disposed inside the stepped portion while extending forwards from a back surface of the sub-door, a second surface extending inclinedly from the first surface outwards and forwards of the stepped portion, and a third surface disposed outwards and forwards of the stepped portion while extending forwards from a front end of the second surface.

The hinge may include an upper hinge pivotably mounted, at one end thereof, to a top surface of the main door, and mounted, at the other end thereof, to a top surface of the sub-door, and a lower hinge pivotably mounted, at one end thereof, to a groove provided at one side of a bottom of the stepped portion in the main door, and mounted, at the other end thereof, to a bottom surface of the sub-door.

A stopper may be provided at the groove, of the main door, to which the lower hinge is mounted, to limit a maximum pivot angle of the lower hinge.

The hinge may include a pivot shaft portion mounted to a groove provided at the main door, a coupling portion coupled to an upper end of the sub-door or a lower end of the sub-door, and a connecting portion to connect the pivot shaft portion and the coupling portion while having a bent structure.

The connecting portion may include a straight section extending from the pivot shaft portion, and a curved section bent from the straight section and connected to the coupling portion.

The main door may include an outer door to form a front surface and side surfaces, the outer door having an opening at an upper portion of the front surface, a door liner to form a back surface, the door liner having an opening at an upper portion thereof, a frame cover mounted to the opening of the outer door while having the stepped portion at a front surface thereof, and cap decorations respectively coupled to top and bottom surfaces formed in accordance with coupling of the outer door and the door liner.

The main door may further include a magnetic gasket mounted to a back surface of the frame cover, and a coupling member to fix the magnetic gasket to the frame cover.

An upper one of the cap decorations may be provided with a pivot groove to form a space, to which the hinge is mounted to pivot.

The sub-door may include an outer door to form a front surface and a side surface, a door liner to form a back surface, a gasket mounted along an edge of the door liner, the gasket receiving a magnet therein, and cap decorations respectively coupled to top and bottom surfaces formed in accordance with the outer door and the door liner, the hinge being coupled to the cap decorations.

The cap decorations may include an upper cap decoration provided, at one side of an upper portion thereof, with a coupling groove, to which the hinge is coupled, and provided, at the other side of the upper portion thereof, with a handle groove, and a lower cap decoration provided, at one side of a lower portion thereof, with a coupling groove, to which the hinge is coupled.

The gasket may include a magnetic member received in the gasket. A metal member or a magnet member may be provided at a front surface of the stepped portion in the main door.

The refrigerator may further de a handle groove provided at one side of an upper portion of the sub-door, a hook member pivotably mounted to one side of the handle groove, an engagement groove provided at the front surface of the main door such that the hook member is selectively engagable in the engagement groove, and a lever member pivotably mounted to the handle groove, to pivot the hook member so as to release an engagement state of the hook member in the engagement groove.

The refrigerator may further include an elastic member mounted between the handle groove and the hook member, to provide an elastic force to pivot the hook member in a direction that the hook member is engaged in the engagement groove.

The main door may further include a handle groove provided at a side surface of the main door.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage chamber;

a main door coupled to the cabinet via a first upper hinge and a first lower hinge, having a front surface, a rear surface, edge surfaces, and a front opening, and configured to open or close the storage chamber;

a first gasket mounted along a peripheral area of the rear surface of the main door;

a metal member mounted on the front surface of the main door;

a plurality of racks mounted on the main door;

a sub-door coupled to the main door via a second upper hinge and a second lower hinge, having a front surface, a rear surface, and edge surfaces, and configured to rotate in a direction identical to the main door;

a second gasket mounted along a peripheral area of the rear surface of the sub-door, having a magnetic member, and configured to stick to the front surface of the main door due to attraction force with the metal member when the sub-door closes;

a handle groove configured to allow a user to pull the sub-door, the handle groove recessed inward from one of the edge surfaces;

a groove portion provided beside the handle groove and in communication with the handle groove;

an axial groove formed within the handle groove;

a lever member configured to rotate within the handle groove and having a pivot axial protrusion which pivots in the axial groove;

a hook member having a first extension that transfers force from the lever member, and a hook bent from the first extension portion and protruding rearwards from the rear surface of the sub-door, the hook member provided within the groove portion and configured to rotate vertically about an axial protrusion;

an engagement groove provided on a front surface of the main door and configured to accept the hook; and an elastic member provided within the groove portion and configured to provide an elastic force to the hook member to engage with the engagement groove, wherein a lever projecting from the lever member is arranged within the groove portion.

2. The refrigerator according to claim 1, wherein the main door has a frame cover defining the front surface, and wherein the metal member is installed in the frame cover.

3. The refrigerator according to claim 1, further including:

a bracket having a groove coupled to the axial protrusion of the hook member and mounted on the groove portion.

4. The refrigerator according to claim 1, wherein the lever is formed on a surface of the lever member, wherein the lever contacts the first extension.

5. The refrigerator according to claim 1, wherein the handle groove has a rectangular shape.

6. The refrigerator according to claim 1, wherein the lever member forms a rectangular shape.

7. The refrigerator according to claim 1, wherein the main door has a cap decoration defining the main door, and wherein the handle groove is formed on the cap decoration.

* * * * *